United States Patent [19]

Lohrberg et al.

[11] Patent Number: 4,502,935

[45] Date of Patent: Mar. 5, 1985

[54] ELECTROLYTIC CELL HAVING A MEMBRANE AND VERTICAL ELECTRODES

[75] Inventors: Karl Lohrberg, Heusenstamm; Peter Kohl, Neuberg; Günter Haas, Oberursel, all of Fed. Rep. of Germany

[73] Assignee: Metallgesellschaft Aktiengesellschaft, Frankfurt am Main, Fed. Rep. of Germany

[21] Appl. No.: 507,840

[22] Filed: Jun. 24, 1983

[30] Foreign Application Priority Data

Jun. 25, 1982 [DE] Fed. Rep. of Germany ..... 3223701

[51] Int. Cl.[3] ..... C25B 9/00; C25B 9/04

[52] U.S. Cl. ..... 204/253; 204/258; 204/282; 204/288

[58] Field of Search ..... 204/252, 253, 256, 258, 204/266, 286, 288, 289, 255, 257, 282, 283

[56] References Cited

U.S. PATENT DOCUMENTS

| | | | |
|---|---|---|---|
| 3,824,173 | 7/1974 | Bouy et al. | 204/284 |
| 3,960,699 | 6/1976 | Bortak et al. | 204/268 |
| 4,056,458 | 11/1977 | Pohto et al. | 204/263 |
| 4,088,558 | 5/1978 | Fabian et al. | 204/288 |
| 4,154,667 | 5/1979 | Pohto et al. | 204/286 |
| 4,389,298 | 6/1983 | Pellegri | 204/288 |

*Primary Examiner*—Howard S. Williams
*Assistant Examiner*—T. L. Williams
*Attorney, Agent, or Firm*—Karl F. Ross

[57] ABSTRACT

In an electrolytic cell having a membrane and vertical electrodes composed of a plurality of units, a. the electrode having one polarity is horizontally divided into a plurality of units, b. the electrode having the opposite polarity is vertically divided into a plurality of units, and c. the units of at least one of the two electrodes are adapted to be displaced by spring elements. Spacers are suitably provided between the units of that electrode which is not contacted by the membrane.

4 Claims, 7 Drawing Figures

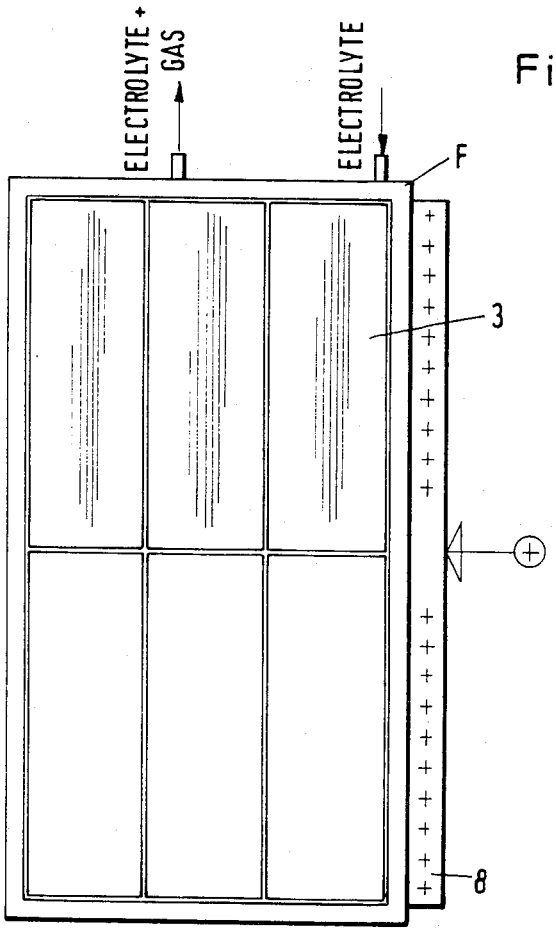
Fig.1b
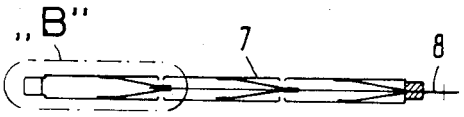
Fig.1c
Fig. 4
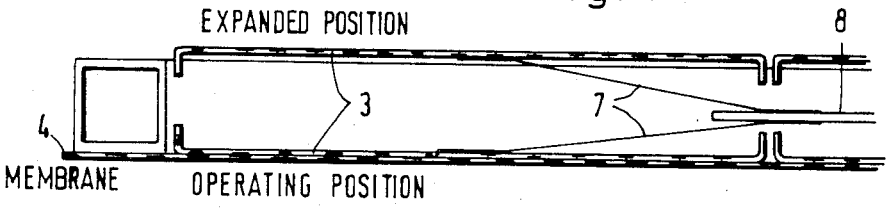

ELECTROLYTIC CELL HAVING A MEMBRANE AND VERTICAL ELECTRODES

FIELD OF THE INVENTION

Our present invention relates to an electrolytic cell having a membrane and vertical electrodes and intended for use in electrochemical processes.

BACKGROUND OF THE INVENTION

In electrochemical processes it is essential to ensure a uniform distribution of the current over the surface of the electrode. The uniform distribution depends on the throwing power of the electrolyte and on the homogeneity of the electrodes. The throwing power will be improved as the area on which the flux lines are incident on the counterelectrode is increased.

Although an inadequate throwing power can be increased by an increase of the electrode spacing, this will also increase the voltage drop of the cell. Inhomogeneities of the electrode surface will result in a deformation of the flux lines. For these reasons the distance between the electrode plates, i.e. the distance between the anode and cathode, is of essential significance.

In an ideal case the confronting surfaces of the two electrodes are parallel. The provision of parallel planar surfaces is a requirement for efficient cell operation because a uniform distribution of the electric current can be ensured and local overheating can be avoided only in that case.

In order to minimize the voltage drop and thus to reduce the energy consumption, the distance between the anode and cathode should be minimized. While all these requirements can be met in a relatively simple manner in small laboratory cells, difficulties are involved in the design of large industrial units if the theoretical requirements are to be met in a perfect manner.

Furthermore, cells become more sensitive to deviations from planar parallelism and to a deformation of the flux lines as the size of the cells increases. To avoid an accelerated destruction of the ion exchange membrane, it is generally necessary to limit the height of the electrodes, to provide a substantial distance between the electrodes of the cell, and to limit the electric current density although this will decrease the energy yield and the productivity of the electrolytic cell.

In order to reduce these disadvantages of electrolytic cells having membranes and vertical electrodes, it is conventional to use electrodes which have openings for the escape of the reaction gases. Such electrodes can be perforated or can consist of wire mesh or expanded metal. The disadvantages of these electrodes derive, inter alia, from the smaller active surface, the lack of mechanical stability and the loss of high-grade coating material on the rear of the electrodes.

Membrane cells having ion exchange membranes are usually provided with a frame structure which is as rigid as possible and in which the electrodes are rigidly mounted, in most cases by welded joints. In order to ensure that the electrodes are planoparallel within the close tolerance range which is required, on the one hand, and that a large number of such frames can be joined to form a leakage-free electrolyser which is similar to a filter press, the contact surfaces of the frames must also be machined in expensive operations.

In accordance with a proposal known from German Patent document DE-AS 20 59 868 gas-forming membrane cells have also been provided with platelike vertical electrodes consisting each of a plurality of plates formed with surfaces for guiding the gas which has been evolved and is to be discharged. The inclination of the guide plate or guiding surface necessarily involves different distances from the active surface to the counterelectrode and particularly local temperature increases may easily result in a warping of the delicate partitions, which are poor conductors of heat. It is also not possible to provide between the entire active surface of the electrode and the counterelectrode the small distance which would be desirable from the energy point of view.

OBJECTS OF THE INVENTION

For this reason it is an object of the invention to avoid the disadvantages which have been stated hereinbefore and other disadvantages and to provide for an electrolytic cell having a membrane, an electrode arrangement which even under industrial conditions of operation ensures that the electrodes will have parallel planar surfaces and a very small spacing, which is desirable from an energy point of view, and the gases will be reliably and quickly discharged.

It is another object of the invention to provide an improved electrolytic cell, e.g. of the gas-generating membrane type of the aforementioned publication, with an improved electrode assembly capable of obviating the above-mentioned disadvantages.

SUMMARY OF THE INVENTION

These objects and others which will become apparent hereinafter are attained in accordance with the present invention with an electrode assembly for an electrolytic gas-generating cell (preferably having a membrane as in the German patent document 20 59 868) wherein one of the two juxtaposed electrodes of opposite polarity is horizontally divided (i.e. is subdivided into a multiplicity of vertically spaced mutually parallel horizontal strips which are coplanar and separated by horizontal gaps of uniform width) and the other electrode is vertically subdivided (i.e. is subdivided into a multiplicity of horizontally spaced mutually parallel vertical strips separated by vertical gaps of uniform width, the gaps of both electrodes being narrower than the strips thereof).

Spacers can be provided between the strips of the two electrodes and blades of leaf springs from the current-supply busbars can bear against the strips of the electrodes of the respective polarity to make electrical contact and form with the busbars channels for carrying off gas.

More specifically the invention provides an electrolytic cell having a membrane and vertical electrodes composed of a plurality of units. According to the invention:

a. the electrode having one polarity is horizontally divided into a plurality of units,
b. the electrode having the opposite polarity is vertically divided into a plurality of units, and
c. the units of at least one of the two electrodes are adapted to be displaced by spring elements.

With the arrangement according to the invention the two geometrical systems of reference provided in the cells namely frame-frame and anode-cathode, are independent of each other. For instance, one electrode, such as the cathode, consists of a plurality of horizontally divided plate sections which extend the full width of and are rigidly connected to the cathode frame. The electrode having the opposite polarity consists of an anode, which is vertically divided into a plurality of vertical plates or strip units and is flexible or displaceable. That flexibility is provided by spring elements, which are suitably provided on the current feeders for the electrodes and establish an electric contact to the several strip units of the electrode (anode) by applying pressure or by welding.

In accordance with the invention, the above-mentioned arrangement may be such that the cathode is flexible whereas the anode is rigidly mounted. Alternatively, both electrodes divided into individual units may be displaceable. In that case the location of the electrodes will not be affected by the inevitable surface irregularities of the contact surfaces of the cell frames but the movable means which connect the current distributor to the active surface of the electrode will bridge the deviations which occur adjacent to the cell frame.

The spring force of the spring elements will be so selected that it will permit an adaptation of the positions of the anode and cathode. The frames may desirably be made from commercially available, drawn material substantially without a need for a subsequent machining, and the close tolerances which are required may be ensured by said spacers.

In another embodiment of the invention the movable or displaceable arrangement of the active surface of the electrodes is designed and used for the discharge of the gas which has been evolved and collected. In this embodiment the spring elements constitute flexible current feeders and are formed with a concave surface facing the bottom of the cell or with an angled surface which is open toward the bottom of the cell. For instance, the spring element may consist of a leaf spring, which is welded to the current feeder. The chlorine gas which is collected under the several flexible spring elements or current feeders is discharged upwardly at one point by gas discharge ducts which are laterally disposed in the electrolyte chamber. This results in a partial degassing of the interelectrode space or anode space. That partial degassing results in convection currents in the electrolytes and in an improved exchange of electrolyte in the active region of the electrodes so that the energy efficiency is greatly improved.

According to the invention, spacers are attached at the horizontal or vertical gaps between the units of that electrode which is not contacted by the membrane. Because the catholyte and anolyte differ in density, the membrane will contact one electrode, which will be subjected to a lateral force, if the hydrostatic heads are equal.

That side force is opposed by the spring force of the flexible current feeders. For this reason the spring forces and the difference between the hydrostatic heads of the anolyte and catholyte cycles will be so matched that the relative position of the two active surfaces can be adjusted without need for exerting a large force, i.e., with a minimum squeezing of the membrane, for instance, by a plurality of horizontal spacers mounted on the cathode. The spacers have preferably a thickness of 1 to 5 mm.

In another embodiment of the invention for use in gas-evolving processes the spacer consists of a duct for conducting evolved gas out of the interelectrode space. If that spacer extends horizontally, it will constitute a gas separator and will consist in that case, e.g. of strip-shaped plates having serrated edges, or of strips having slotlike or circular openings, or of strips forming grids or networks. The provision of such spacers will result in a complete escape of gas from each gap of the electrode (cathode) which is horizontally divided into a plurality of parts.

BRIEF DESCRIPTION OF THE DRAWING

The above and other objects, features and advantages will become more readily apparent from the following description, reference being made to the accompanying drawings, in which:

FIG. 1*b* is a view similar to FIG. 1 but showing the opposite side of the pair of electrodes forming the electrodes flanking a respective membrane;

FIG. 1*c* is a detail of a portion of the electrode assembly.

FIG. 4 is a top plan view of a displaceable anode.

SPECIFIC DESCRIPTION

Figure 1:
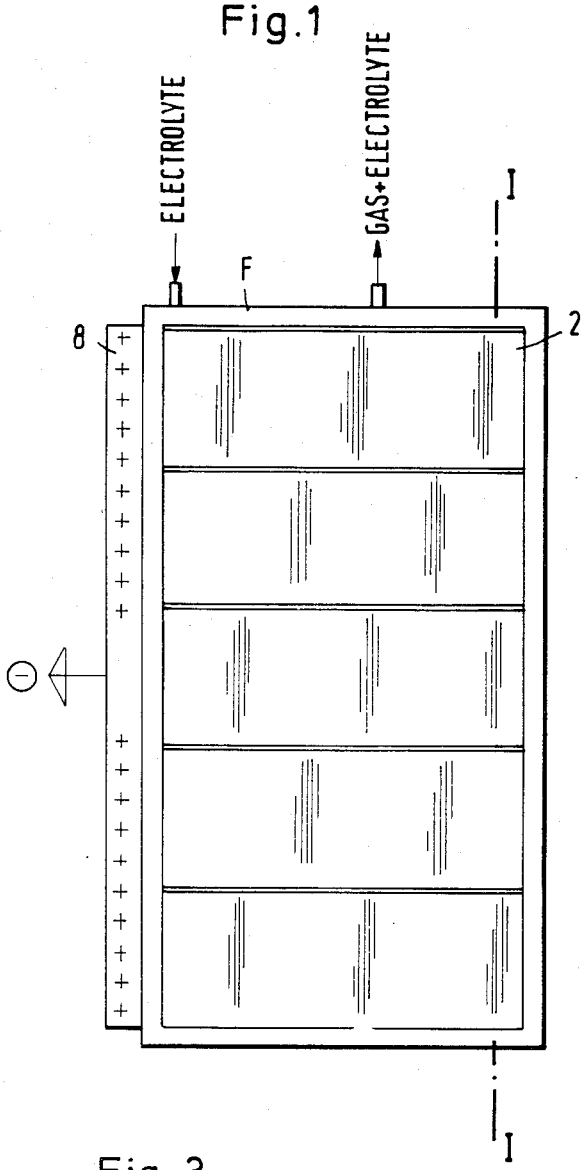
FIG. 1 is a front view of a cathode in a frame F having a spacer between horizontally divided cathode plate.
Figure 2:
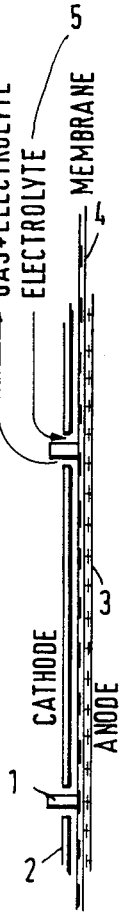
FIG. 2 is a view of a vertical section of the cathode frame in a detail of FIG. 1*a;*
Figure 3:
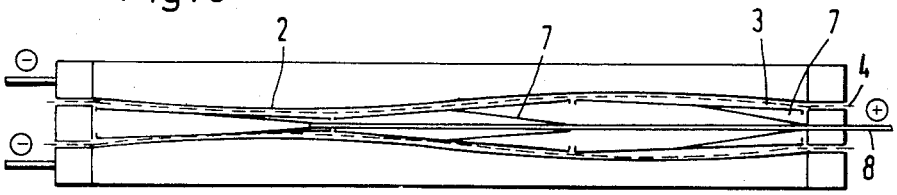
FIG. 3 is a top plan view of a displaceable electrode assembly showing vertical divided anodes and horizontally divided cathodes.

In FIGS. 2–4 of the drawing the membrane has also been shown. It will be understood from FIGS. 1 and 1*b* that the strips of electrodes 2 and 3 are held in a frame F while the contact springs 7 (FIG. 3) press against the strips of electrode 3 which, in turn, presses the membrane 4 against the strips of electrode 2 of the other polarity.

FIG. 1 is a front view of a cathode frame with horizontally divided cathode plate 2, and FIG. 1*b* is a similar view of an anode frame with vertically and horizontally divided anode plate 3.

Figure 1A:
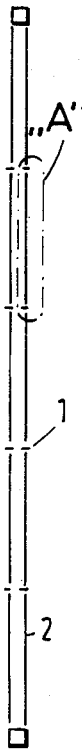
FIG. 1*a* is a section taken along the line I—I of FIG. 1.

FIG. 1*a* is a section according to line I—I in FIG. 1, showing horizontally divided cathode plate 2 and spacer 1.

FIG. 2 is an enlarged view of area "A" in FIG. 1*a*. In FIG. 2 a spacer 1 constitutes a gas discharge duct. The horizontally divided electrode 2 (cathode) and the vertically divided counterelectrode (anode) 3 are shown too. Arrows 5 and 6 indicate the electrolyte-gas mixture as it enters and leaves the cell. FIG. 3 is a top plan view showing a displaceable electrode combination consisting of a horizontally divided cathode 2 and a vertically divided anode 3 and spring elements 7 connected to the current feeder 8.

FIG. 4 which is an enlarged view of area "B" in FIG. 1*c* is a top plan view of a displaceable anode 3, showing diagrammatically a spring element 7, which is connected to the current feeder 8 and to the anodes 3. In the operating position the anode is pressed against the membrane 4.

The electrolytic cell according to the invention has, inter alia, the following advantages. The movable electrode combination has been divided several times and is provided with spring elements so that the smallest critical electrode spacing can be maintained at any time during the operation of the electrolytic cell. That combination eliminates the need for a considerable structural expenditure for the electrodes and for the electrode frames as is otherwise required for the electrodes and the electrode frames in order to maintain close manufacturing tolerances. There is virtually no limit to the height of the electrolytic cell because evolved gas is discharged from the interelectrode gap at each gap between electrode units so that an accumulation of gas is avoided.

SPECIFIC EXAMPLES

EXAMPLE 1

A. Laboratory cell for producing sodium chlorate

| | |
|---|---|
| Size | 50 × 50 mm = 0.0025 $m^2$ |
| Electrode spacing | 5 mm |
| Current density | 3 $kA/m^2$ |
| Voltage drop in electrolyte | 250 mV |

Assumption:

A surface of 1 $cm^2$ is assumed to protrude by 1 mm. The current density at the protruding surface can be ascertained in first approximation from the power input. If the electrodes are planoparallel and uniformly spaced, the power input will be $$3\ kA/m^2 \times 0.0025\ m^2 \times 0.25\ V \times 1000 = 1.875\ VA$$

At the same current density, the surface of 1 $cm^2$, which protrudes 1 mm, will have a power input of $$3\ kA/m^2 \times 0.0001 \times 0.25 \times 4/5 \times 1000 = 0.060VA$$

In that case the power input of the non-protruding surface is $$1.875 \times \frac{25-1}{25} = 1.800\ VA$$

so that the total power input amounts to 1.860 VA This means a decrease in voltage by $$250 \times \frac{1.86}{1.875} = 248\ mV$$

The current density on the non-protruding surface amounts to $$\frac{3 \times 0.0025 - 3.75 \times 0.0001}{0.0025 - 0.00011} = 2.97k\ A/m^2$$

The current density on the protruding surface amounts to $$3\ kA/m^2 \times 5/4\ mm \times 248/250\ mV = 3.72\ kA/m^2$$

B. Membrane Cell for Producing $Cl_2$, NaOH, $H_2$

| | |
|---|---|
| Size | 50 × 50 mm = 0.0025 $m^2$ |
| Electrode spacing | 5.0 mm |
| Current density | 3.0 $kA/m^2$ |
| Voltage drop in electrolyte | 250 mV |
| Voltage drop across the membrane | 400 mV |

Assumption:

1 $cm^2$ of one of the electrodes is assumed to protrude by 1 mm. In that case the same calculation as in Example 1, A gives the following values:

| | |
|---|---|
| Total voltage drop | 648 mV |

-continued

| | |
|---|---|
| Current density on the protruding surface | 3.24 $kA/m^2$ |
| Current density on the non-protruding surface | 2.99 $kA/m^2$ |

It is apparent that the membrane, which constitutes an additional resistor, acts as a stabilizer although the heat generated in the membrane is not substantially increased.

Heat generated in membrane at 3 $kA/m^2$:

$$3 \times 0.4 \times 860 = 1032\ kcal/m^2 \times h.$$

Heat generated at 3.24 $kA/m^2$:

$$3.24 \times 0.4 \times 3.24/3.00 \times 860 = 1204\ kcal/m^2\ h$$

It is apparent that for the same heat dissipation the temperature difference between the membrane and the electrolyte increases by about 20%.

It will be understood that a surface irregularity of 1 mm can be provided only with difficulty in small laboratory cells.

In contrast, surface irregularities of 1 mm cannot be avoided in cells of industrial size without special measures. Economic constraints do not permit spacings of 5 mm in industrial cells. It is desired to use spacings which ensure the smallest voltage drop. In dependence on the configuration of the electrode that spacing is 1 to 3 mm. The entire surface area of the anode or cathode may be of an order of up to 50 $m^2$ and heights of 1.2 m are normally not exceeded. The limitation of the height is due to the inevitable increase of the gas concentration in the electrolyte in the upper portion of the electrolytic cells.

The effect of a smaller spacing and higher gas concentration will now be explained in the following examples.

EXAMPLE 2

Industrial cells

A. Monopolar membrane cell for producing $Cl_2$, NaOH, $H_2$

| | |
|---|---|
| Size: | 16 × 1000 × 1200 mm = 19.2 $m^2$ |
| Electrode spacing | 3 mm |
| Current density | 3 $kA/m^2$ |
| Voltage drop across the electrolyte | 150 mV |
| Voltage drop across the membrane | 400 mV |

Assumption:

Both electrodes have on their confronting surface an area of 10 $cm^2$ which protrudes 0.75 mm.

The same calculation as in Example 1,

A gives the following values:

| | |
|---|---|
| Total voltage drop | 550 mV |
| Current density at the protruding surfaces | 3.47 $kA/m^2$ |

From the ratio of the protruding surface to the remaining surface it is apparent that the total voltage drop is virtually not changed and the current density on the nonprotruding surfaces is not decreased to a measurable extent. But the generation of heat in the membrane (see Example 1,B) increases to 1380 kcal/$m^2$ h, corresponding to 133% of the normal value.

B. Bipolar membrane cell for the production of $Cl_2$ and $H_2$ from waste hydrochloric acid

| | |
|---|---|
| Electrode height | 1.0 m |
| Width | 2.5 m |
| Current density | 4 kA/$m^2$ |
| Electrode form | Integral, vertical, slotted graphite plates having a gas discharge space on 30% of the surface area |
| Measured current density | Upper one-third 3.50 kA/$m^2$<br>Lower one-third 4.60 kA/$m^2$ |

Example 2 reveals the limitations which must be observed in the design of industrial cells owing to a deformation of the flux lines. A tolerance of ±C.75 mm can just be adhered to with a reasonable expenditure. In a cell having a width or height of 1 m, that tolerance means an accuracy of 0.075% of the overall dimension. A free area of 30 to 50% for the discharge of gas is an upper limit because the effective current density rises excessively otherwise.

We claim:

1. A membrane electrolysis cell comprising:

rectangular frames disposed virtually vertically;

the frames having electrodes of one polarity disposed generally vertically and each subdivided horizontally into a plurality of substantially horizontal strips spanning said frames;

respective membranes extending along each of said frames and juxtaposed to a said electrode of one polarity thereof;

respective electrodes of opposite polarity in said frames disposed substantially vertically and each juxtaposed with said membranes whereby each said membrane is deformable toward a said electrode of opposite polarity of an adjacent frame, each of said electrodes of said opposite polarity being subdivided vertically into a plurality of vertical strips spanning said frames; and conductors designed as springs located in said frames pressing outwardly against the strips of at least one of the electrodes juxtaposed with each membrane to deform the strips toward the strips of the other electrode juxtaposed therewith.

2. The membrane electrolysis cell defined in claim 1, further comprising spacers between the strips of said other electrode.

3. The membrane electrolysis cell defined in claim 2 wherein said spacers form ducts for discharging gases from a respective interelectrode gap.

4. The membrane electrolysis cell defined in claim 1 wherein said contact springs form gas discharge ducts.

* * * * *